US008316954B2

(12) United States Patent
McGlothen

(10) Patent No.: US 8,316,954 B2
(45) Date of Patent: Nov. 27, 2012

(54) APPARATUS AND METHOD FOR SEPARATING A DOWNHOLE TUBULAR STRING INTO TWO PARTS

(75) Inventor: Jody R. McGlothen, Waxahachie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 357 days.

(21) Appl. No.: 12/644,959

(22) Filed: Dec. 22, 2009

(65) Prior Publication Data

US 2011/0146988 A1 Jun. 23, 2011

(51) Int. Cl.
*E21B 19/00* (2006.01)

(52) U.S. Cl. ..... 166/377; 166/381; 166/382; 166/237

(58) Field of Classification Search ..... 166/381, 166/382, 377, 237, 242.6, 242.7
See application file for complete search history.

(56) References Cited

U.S. PATENT DOCUMENTS

| | | | | | |
|---|---|---|---|---|---|
| 788,353 | A * | 4/1905 | Downing | 277/338 |
| 2,017,434 | A * | 10/1935 | Church | 166/124 |
| 2,845,126 | A * | 7/1958 | Brown | 166/119 |
| 3,308,882 | A * | 3/1967 | Lebourg | 73/152.23 |
| 3,693,254 | A * | 9/1972 | Salonen | 30/228 |
| 3,885,851 | A * | 5/1975 | Bennett | 439/352 |
| 4,312,173 | A * | 1/1982 | Killermann | 53/556 |
| 5,560,650 | A * | 10/1996 | Woycik et al. | 280/777 |
| 5,823,264 | A | 10/1998 | Ringgenberg | |
| 6,155,150 | A * | 12/2000 | Cooper et al. | 83/13 |
| 6,213,206 | B1 * | 4/2001 | Bakke | 166/242.7 |
| 6,367,552 | B1 | 4/2002 | Scott et al. | |
| 6,439,305 | B1 * | 8/2002 | Bakke | 166/242.6 |
| 6,540,025 | B2 | 4/2003 | Scott et al. | |
| 6,772,844 | B2 * | 8/2004 | Lloyd et al. | 166/387 |
| 7,044,231 | B2 * | 5/2006 | Doane et al. | 166/380 |
| 7,090,257 | B2 * | 8/2006 | Werth | 285/243 |
| 7,431,094 | B2 * | 10/2008 | De Clute-Melancon | 166/377 |
| 7,537,060 | B2 * | 5/2009 | Fay et al. | 166/382 |
| 7,581,595 | B2 * | 9/2009 | Fay et al. | 166/382 |
| 7,604,061 | B2 * | 10/2009 | Fay et al. | 166/382 |
| 7,640,977 | B2 * | 1/2010 | Jonas | 166/242.6 |
| 2004/0216887 | A1 * | 11/2004 | Bertelsen | 166/377 |
| 2005/0087338 | A1 * | 4/2005 | Parker | 166/242.6 |
| 2006/0113083 | A1 * | 6/2006 | Connell et al. | 166/377 |
| 2007/0034372 | A1 * | 2/2007 | Moyes | 166/250.1 |
| 2007/0056744 | A1 * | 3/2007 | Ellington et al. | 166/380 |

* cited by examiner

*Primary Examiner* — Shane Bomar
*Assistant Examiner* — Tamatane Aga
(74) *Attorney, Agent, or Firm* — Lawrence R. Youst

(57) ABSTRACT

An apparatus for separating a downhole tubular string into two parts. The apparatus includes a receptacle operably associated with a first part of the downhole tubular string and a mandrel operably associated with a second part of the downhole tubular string. First and second sleeves each having a profile are slidably positioned between the receptacle and the mandrel and are operable to be securably coupled to the mandrel in first and second positions relative to the mandrel. First and second rings are respectively positioned between the profiles of the first and second sleeves and the profiled surface of the receptacle. The first and second rings are operable to initially limit longitudinal movement of the receptacle relative to the mandrel, to prevent tubular string recoil during operation and to allow longitudinal movement of the receptacle relative to the mandrel after operation.

20 Claims, 5 Drawing Sheets

APPARATUS AND METHOD FOR SEPARATING A DOWNHOLE TUBULAR STRING INTO TWO PARTS

FIELD OF THE INVENTION

This invention relates, in general, to equipment utilized in conjunction with operations performed in subterranean wells and, in particular, to an apparatus and method for disconnecting an upper part of a tubular string from a lower part of a tubular string during downhole operations.

BACKGROUND OF THE INVENTION

Without limiting the scope of the present invention, its background is described with reference to safety joints, as an example.

It is common practice in the wellbore drilling and completion arts to include a safety joint in a downhole tubular string to provide a point of separation in the tubular string such that the portion of the tubular string uphole of the safety joint can be retrieved to the surface while leaving the portion of the tubular string downhole of the safety joint in the wellbore. Safety joints are useful in a variety of circumstances. For example, safety joints are commonly used during the installation of certain tools, such as packers, in a wellbore. Similarly, safety joints are useful in allowing the recovery of a majority of the tubular string when an element of the tubular string below the safety joint become stuck or during fishing operations to recover a downhole element that was previously stuck in the wellbore, without the risk of sticking the entire recovery tubular string during the fishing operation.

Conventional safety joints have been operated using a variety of complicated or risky techniques. For example, certain safety joints have been operated by reciprocating the tubular string up and down while maintaining right-hand torque on the tubular string. In this design, the tubular string reciprocation and right-hand torque backs off a left-hand exterior threaded nut within the housing, which nut prevents the mandrel of the safety joint from coming free from the housing during normal tubular string movement. It has been found, however, that while this type of safety joint may be acceptable in some circumstances, there are occasions when the amount of right-hand torque which can be applied to a tubular string while reciprocating the string is limited by the ability of tools in the tubular string to withstand the required torque.

In another design, the safety joint is operated by neutralizing the weight of the tubular string at the location of the safety joint and rotating the tubular string to the right, which rotation backs off a left-hand exterior threaded nut within the housing. It has been found, however, that in certain wellbore configurations such as deep or deviated wellbores, torque does not transmit well along the tubular string such that the tubular string itself can be put under large amounts of force which can damage the tubular string.

In still other designs, the safety joint includes a release sleeve coupled to a mandrel with one or more shearable elements which must be parted by the application of a predetermined tensile or compressive force on the tubular string to enable the desired separation. It has been found, however, that the application of the required tensile or compression force on the tubular string elongates or compresses the tubular string prior to parting the shearable elements. Upon parting of the shearable elements, the tubular string violently recoils within the wellbore, which may cause damage to components in the wellbore or within the tubular string. In addition, it has been found, that during the recoil of the tubular string, the maximum allowable flowrate through certain components of the tubular string may be exceeded.

Accordingly, a need has arisen for an improved apparatus and method for disconnecting an upper part of a tubular string from a lower part of a tubular string during downhole operations. A need has also arisen for such an apparatus and method that enable separating the tubular string into two parts without the use of complicated or risky techniques. In addition, a need has arisen for such an apparatus and method that enable separating the tubular string into two parts without the need to perform rotations of the tubular string. Further, a need has arisen for such an apparatus and method that enable separating the tubular string into two parts without causing the tubular string to recoil due to tensile elongation.

SUMMARY OF THE INVENTION

The present invention disclosed herein is directed to an improved apparatus and method for disconnecting an upper part of a tubular string from a lower part of a tubular string during downhole operations. The apparatus and method of the present invention enable separating the tubular string into two parts without the use of complicated or risky techniques. Also, the apparatus and method of the present invention enable separating the tubular string into two parts without the need to perform rotations of the tubular string. In addition, the apparatus and method of the present invention enable separating the tubular string into two parts without causing the tubular string to recoil due to tensile elongation.

In one aspect, the present invention is directed to an apparatus for separating a downhole tubular string into two parts. The apparatus includes a receptacle having a profiled surface that is operably associated with a first part of the downhole tubular string. A mandrel is operably associated with a second part of the downhole tubular string. The mandrel is slidably positioned relative to the receptacle. A first sleeve having a profile is slidably positioned between the receptacle and the mandrel. The first sleeve is operable to be securably coupled to the mandrel in first and second positions relative to the mandrel. A second sleeve having a profile is also positioned between the receptacle and the mandrel. A first ring is slidably positioned between the profile of the first sleeve and the profiled surface of the receptacle. A second ring is slidably positioned between the profile of the second sleeve and the profiled surface of the receptacle. The first and second rings initially limit longitudinal movement of the receptacle relative to the mandrel in first and second directions.

Upon application of a predetermined longitudinal force between the mandrel and the receptacle, the receptacle engages the second ring such that the second ring engages the first ring which shifts the first sleeve from the first position to the second position and allows the second ring to slide off the profile of the second sleeve such that the receptacle engages the first ring, thereby limiting longitudinal movement of the receptacle in the first direction. Upon subsequent movement of the receptacle in the second direction relative to the mandrel, the receptacle engages the first ring such that the first ring slides off the profile of the first sleeve, thereby allowing longitudinal movement of the receptacle relative to the mandrel in both the first and second directions.

In one embodiment, the profiled surface of the receptacle may be formed in a radially increased portion of an inner surface of the receptacle. In another embodiment, the mandrel may include a radially reduced portion that is operable to receive the first and second sleeves. In yet another embodiment, the receptacle may be positioned to the exterior of the mandrel. In this and other embodiments, at least one seal may be positioned between the receptacle and the mandrel. In one embodiment, the first sleeve may be securably coupled to the mandrel in the first position with at least one shear pin and may be securably coupled to the mandrel in the second position with a retaining ring. In this and other embodiments, the first and second rings may be split rings that are radially outwardly biased when positioned respectively on the profiles of the first and second sleeves.

In another aspect, the present invention is directed to an apparatus for separating a downhole tubular string into two parts. The apparatus includes a receptacle having a profiled surface that is operably associated with a first part of the downhole tubular string. A mandrel is operably associated with a second part of the downhole tubular string. The mandrel is slidably positioned relative to the receptacle. First and second sleeves are slidably positioned between the receptacle and the mandrel and are operable to be securably coupled to the mandrel in first and second positions relative to the mandrel. The first and second sleeves each have a profile. First and second rings are slidably positioned respectively between the profiles of the first and second sleeves and the profiled surface of the receptacle. The first and second rings initially limit longitudinal movement of the receptacle relative to the mandrel in first and second directions.

Upon application of a predetermined longitudinal force between the mandrel and the receptacle, the receptacle engages the second ring such that the second ring engages the first ring which shifts the first sleeve from the first position to the second position and allows the second ring to slide off the profile of the second sleeve such that the receptacle engages the first ring, thereby limiting longitudinal movement of the receptacle in the first direction. Upon subsequent movement of the receptacle in the second direction relative to the mandrel, the receptacle engages the first ring such that the first ring slides off the profile of the first sleeve, thereby allowing longitudinal movement of the receptacle relative to the mandrel in both the first and second directions.

In a further aspect, the present invention is direct to a method for separating a downhole tubular string into two parts. The method includes operably associating a receptacle with a first part of the tubular string and a mandrel with a second part of the tubular string; initially limiting movement in first and second longitudinal directions of the receptacle relative to the mandrel within a range between first and second positions; applying a predetermined longitudinal force between the mandrel and the receptacle; shifting the receptacle in the first direction relative to the mandrel to a third position that is outside of the range; limiting further movement of the receptacle relative to the mandrel in the first direction beyond the third position; releasing the predetermined longitudinal force between the mandrel and the receptacle; and shifting the receptacle in the second direction relative to the mandrel to a fourth position that is within the range to enable longitudinal movement of the receptacle in both the first and second directions.

The operation of applying a predetermined longitudinal force between the mandrel and the receptacle may also include parting at least one shearable element, applying a tensile force between the mandrel and the receptacle or applying a compressive force between the mandrel and the receptacle.

In an additional aspect, the present invention is direct to a method for separating a downhole tubular string into two parts. The method includes operably associating a receptacle with a first part of the tubular string and a mandrel with a second part of the tubular string, the receptacle and the mandrel having first and second sleeves disposed therebetween; initially limiting longitudinal movement of the receptacle relative to the mandrel in first and second directions with first and second rings respectively positioned between profiles of the first and second sleeves and a profiled surface of the receptacle; applying a predetermined longitudinal force between the mandrel and the receptacle such as a tensile force or a compressive force; engaging the second ring with the receptacle to shift the first sleeve from a first position to a second position relative to the mandrel and to slide the second ring off the profile of the second sleeve such that the receptacle engages the first ring which limits longitudinal movement of the receptacle in the first direction; and moving the receptacle in the second direction relative to the mandrel to slide the first ring off the profile of the first sleeve, thereby allowing longitudinal movement of the receptacle in both the first and second directions.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
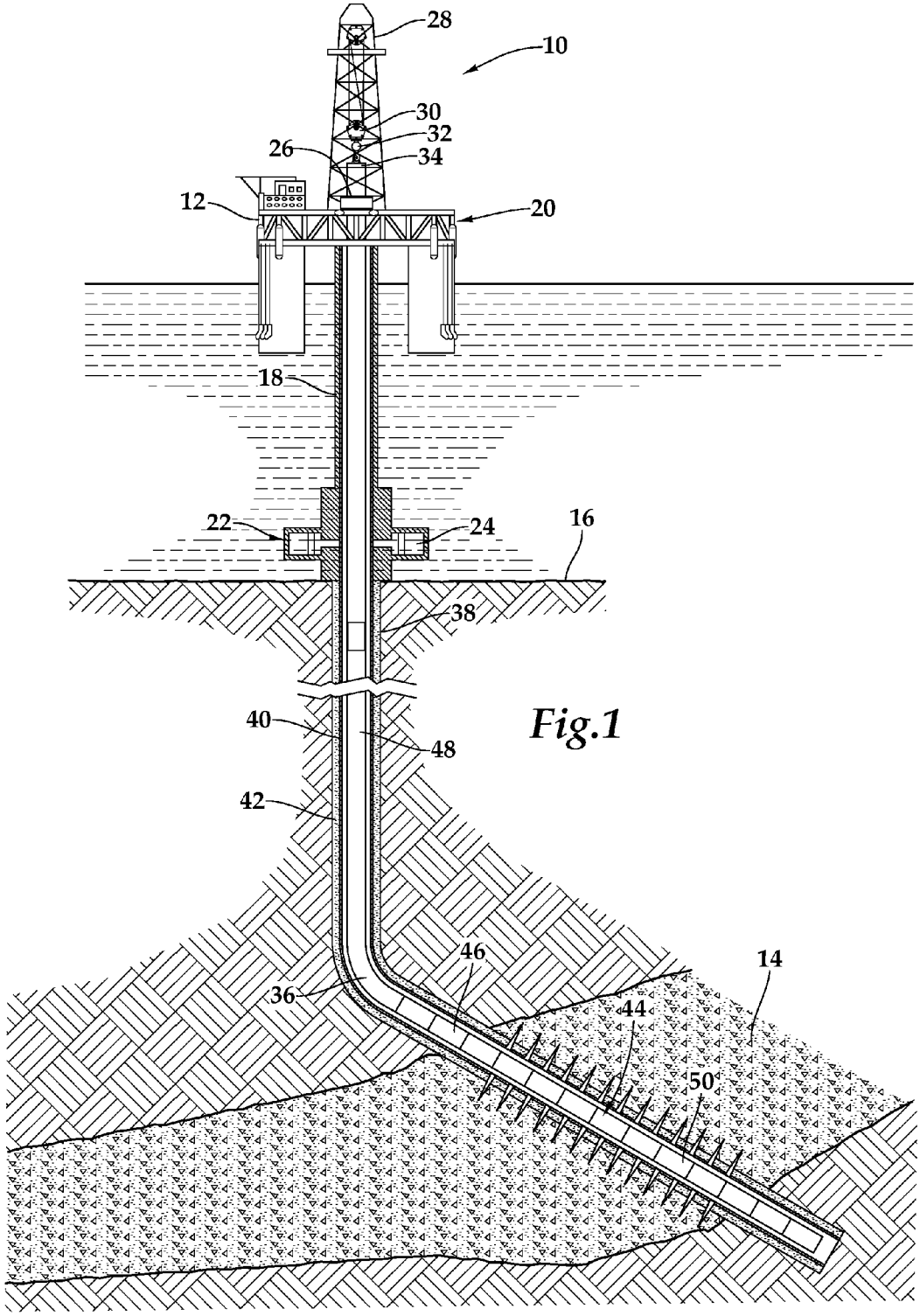
FIG. 1 is a schematic illustration of an offshore oil and gas platform operating an apparatus for disconnecting an upper part of a tubular string from a lower part of a tubular string during downhole operations according to an embodiment of the present invention.

Referring initially to FIG. 1, an apparatus for disconnecting an upper part of a tubular string from a lower part of a tubular string being deployed from an offshore platform is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a tubular string 36.

A wellbore 38 extends through the various earth strata including formation 14. Wellbore 38 includes casing that is cemented within wellbore 38 by cement 42. Disposed within the lower portion of wellbore 38 as part of tubular string 36 is a tool string 44 including a variety of tools such as safety devices, flow control devices, sand control screens, packers and the like that are used to complete the well. In addition, tubular string 36 includes a safety joint 46 that provides a point of separation in tubular string 36 such that an upper portion 48 of the tubular string 36 can be retrieved to the surface while leaving a lower portion 50 of tubular string 36 downhole. Safety joint 46 may be used to disconnect upper portion 48 from lower portion 50 after the installation of tool string 44 or in the event a tool within tool string 44 become stuck in wellbore 38 prior proper installation. In either case, safety joint 46 may be operated using a combination of compressive and tensile forces to disconnect upper portion from lower portion 50 as described in greater detail below.

Even though FIG. 1 depicts a deviated wellbore, it should be understood by those skilled in the art that the apparatus for disconnecting an upper part of a tubular string from a lower part of a tubular string of the present invention is equally well suited for use in wellbores having other directional orientations including vertical wellbores, horizontal wellbores, multilateral wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the uphole direction being toward the top or the left of the corresponding figure and the downhole direction being toward the bottom or the right of the corresponding figure. Also, even though FIG. 1 depicts an offshore operation, it should be understood by those skilled in the art that the apparatus for disconnecting an upper part of a tubular string from a lower part of a tubular string of the present invention is equally well suited for use in onshore operations.

Figure 2:
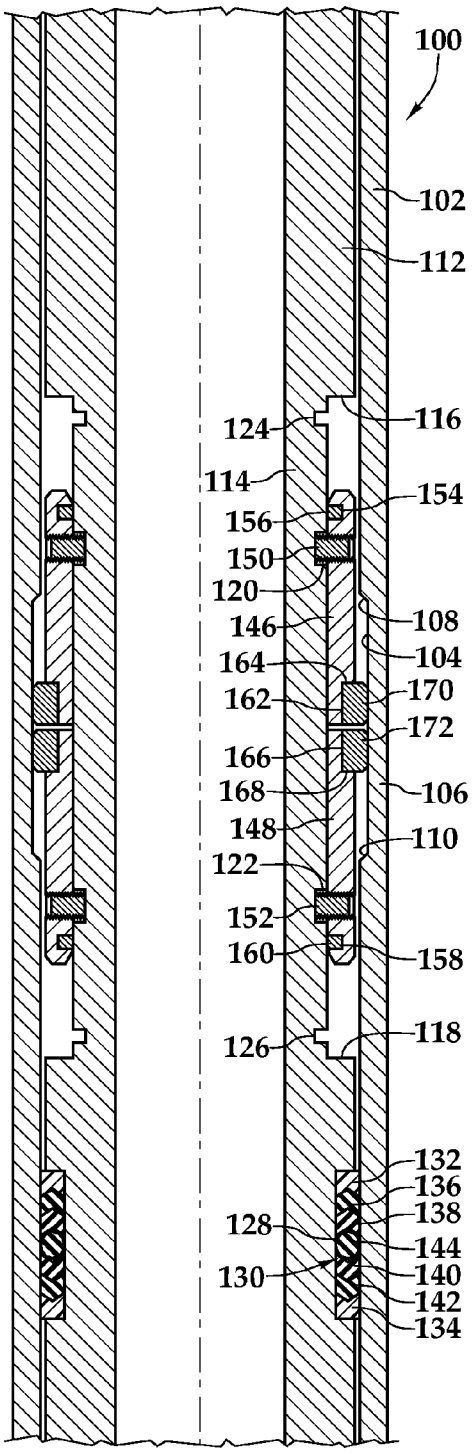
FIG. 2 is a cross sectional view of an apparatus for disconnecting an upper part of a tubular string from a lower part of a tubular string during downhole operations in a first configuration according to an embodiment of the present invention.

Referring next to FIG. 2, therein is depicted an apparatus for disconnecting an upper part of a tubular string from a lower part of a tubular string or safety joint 100 according to the present invention. Safety joint 100 includes a longitudinally extending, generally tubular receptacle 102. Receptacle 102 includes a profiled surface 104 that is depicted as a radially increased annular portion 106 of the inner surface of receptacle 102 that defines an upper shoulder 108 and a lower shoulder 110. Preferably, receptacle 102 is operably associated with the lower portion of the downhole tubular string in which safety joint 100 is a part. Even though FIG. 2 depicts receptacle 102 as a single tubular member, those skilled in the art will recognize that receptacle 102 could alternatively be formed from a plurality of tubular sections that are threadably or otherwise secured together.

Safety joint 100 includes a longitudinally extending, generally tubular mandrel 112. Mandrel 112 includes a radially reduced annular portion 114 that defines an upper shoulder 116 and a lower shoulder 118. Mandrel 112 includes an upper shear pin receiving groove 120 and a lower shear pin receiving groove 122. Alternatively, mandrel 112 may have discrete shear pin receiving openings that may be individually threaded to receive shear screws therein. Mandrel 112 also includes an upper retainer ring receiving groove 124 and a lower retainer ring receiving groove 126. Preferably, mandrel 112 is operably associated with the upper portion of the downhole tubular string in which safety joint 100 is a part. Even though FIG. 2 depicts mandrel 112 as a single tubular member, those skilled in the art will recognize that mandrel 112 could alternatively be formed from a plurality of tubular sections that are threadably or otherwise secured together.

Mandrel 112 includes a gland groove 128 that is operable to receive a sealing array 130 therein that provides a seal between mandrel 112 and receptacle 102. In the illustrated embodiment, sealing array 130 includes a pair of oppositely disposed adaptor members 132, 134, a pair of upper back up rings depicted as V-rings 136, 138, a pair of lower back up rings depicted as V-rings 140, 142, and an energizing element depicted as O-ring seal 144. It should be understood by those skilled in the art that the material or materials selected for the V-rings and O-ring is based upon factors such as chemical compatibility, application temperature, sealing pressure and the like. In addition, even though a particular sealing array has been depicted and described, those skilled in the art will understand that other sealing systems having a greater number of seal elements or a lesser number of seal elements could alternatively be used in conjunction with the present invention. Further, in certain embodiments of the present invention, no sealing array or seal is required.

Safety joint 100 includes a longitudinally extending, generally tubular upper sleeve 146 and a longitudinally extending, generally tubular lower sleeve 148. Upper and lower sleeves 146, 148 are slidably received around radially reduced annular portion 114 of mandrel 112. As illustrated, upper sleeve 146 is secured to mandrel 112 via a plurality of shearable elements depicted as shear pins 150 that may be threadably received within a like number of openings that extend through the wall of upper sleeve 146. Likewise, lower sleeve 148 is secured to mandrel 112 via a plurality of shearable elements depicted as shear pins 152 that may be threadably received within a like number of openings that extend through the wall of lower sleeve 148. Upper sleeve 146 includes a retainer ring groove 154 that houses a retainer ring 156. Lower sleeve 148 includes a retainer ring groove 158 that houses a retainer ring 160. Upper sleeve 146 includes an annular profile 162 that defines an annular shoulder 164. Lower sleeve 148 includes an annular profile 166 that defines an annular shoulder 168.

Safety joint 100 includes an upper ring 170 and a lower ring 172. Upper ring 170 is positioned on profile 162 of upper sleeve 146. Lower ring 172 is positioned on profile 166 of lower sleeve 148. Preferably, upper ring 170 and lower ring 172 are in the form of C-rings or split rings and are biased outwardly when positioned on profile 162 and profile 166, respectively and have a free configuration that is sized to be tight around mandrel 112 for the reasons discussed below. As illustrated in FIG. 2, upper ring 170 and lower ring 172 are also received within profiled surface 104 of receptacle 102. In this configuration, upper ring 170 and lower ring 172 limit the longitudinal travel of receptacle 102 relative to mandrel 112 within a predetermined range. Specifically, receptacle 102 can travel between the point at which shoulder 108 contacts upper ring 170 and the point at which shoulder 110 contacts lower ring 172. In the illustrated embodiment, further downward travel of receptacle 102 relative to mandrel 112 is prevented by shear pins 152 due to contact between upper ring 170 and lower ring 172. Likewise, further upward travel of receptacle 102 relative to mandrel 112 is prevented by shear pins 150 due to contact between lower ring 172 and upper ring 170.

Figure 3:
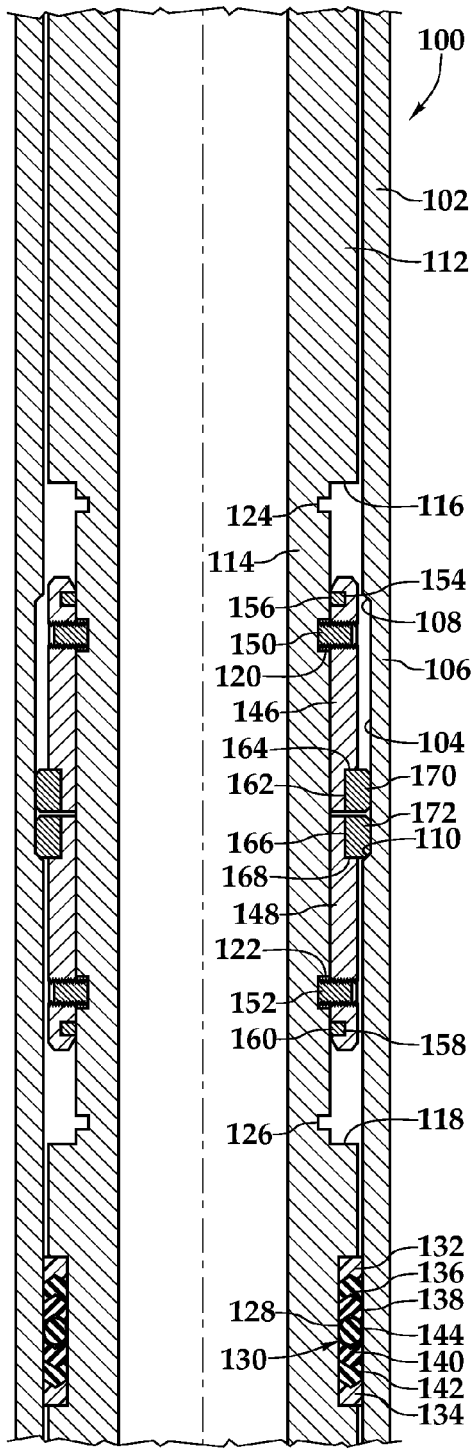
FIG. 3 is a cross sectional view of an apparatus for disconnecting an upper part of a tubular string from a lower part of a tubular string during downhole operations in a second configuration according to an embodiment of the present invention.
Figure 4:
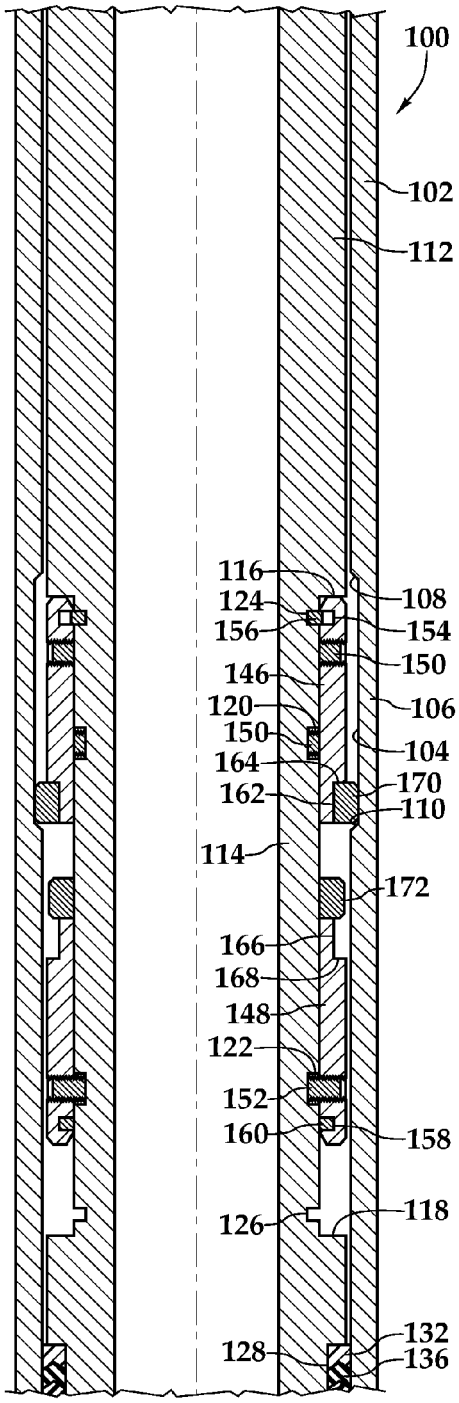
FIG. 4 is a cross sectional view of an apparatus for disconnecting an upper part of a tubular string from a lower part of a tubular string during downhole operations in a third configuration according to an embodiment of the present invention.
Figure 5:
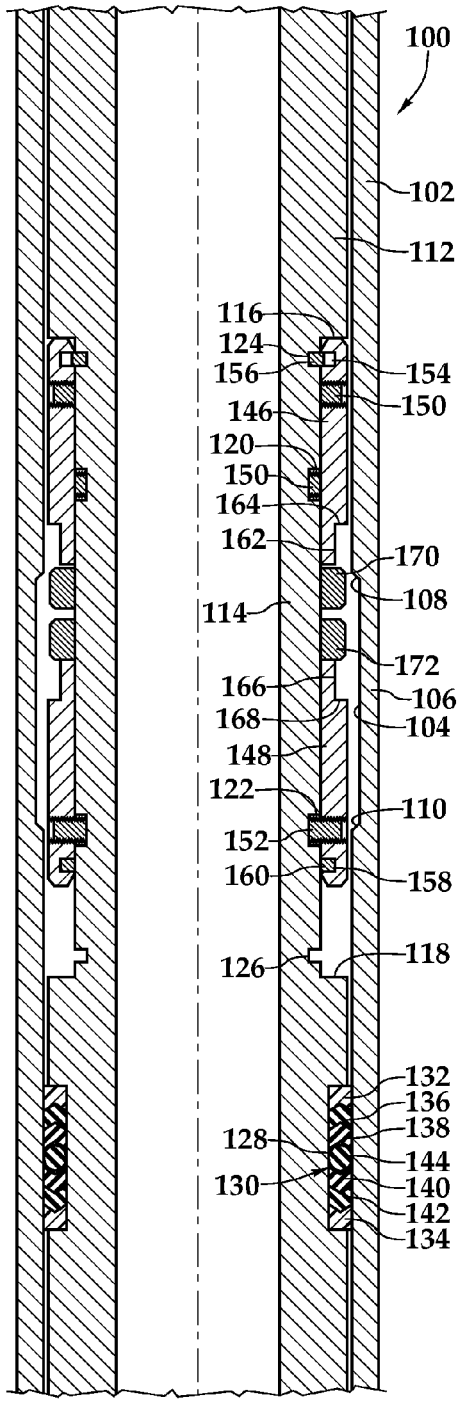
FIG. 5 is a cross sectional view of an apparatus for disconnecting an upper part of a tubular string from a lower part of a tubular string during downhole operations in a fourth configuration according to an embodiment of the present invention.

A first operating mode of safety joint 100 will now be described with reference to FIGS. 3-5. As illustrated in FIG. 3, weight is being applied from the surface which has caused mandrel 112 to move downhole relative to receptacle 102 such that lower ring 172 has come in contact with or been engaged by shoulder 110 of receptacle 102. In this configuration, application of a predetermined compressive longitudinal force between mandrel 112 and receptacle 102 causes shear pins 150 to part due to the force of lower ring 172 on upper ring 170. When shear pins 150 part, upper sleeve 146 is shifted in the uphole direction until upper sleeve 146 contacts shoulder 116, as best seen in FIG. 4. In this position, retainer ring 156 snaps into retainer ring receiving groove 124 which prevents subsequent longitudinal movement of upper sleeve 146.

During the initial movement of upper sleeve 146, lower ring 172 slides along profile 166 until support thereunder is lost. Lower ring 172 then snaps into contact with mandrel 112. In this configuration, lower ring 172 no longer limits longitudinal travel of receptacle 102 relative to mandrel 112. The longitudinal travel of receptacle 102 relative to mandrel 112 in the uphole direction outside of the initial range is allowed but the extent of the travel is now limited by upper ring 170 due to the engagement of shoulder 110 of receptacle 102 with upper ring 170. In this manner, any compression in the tubular string during the operation of safety joint 100 will not result in recoil of the tubular string as the distance receptacle 102 can travel relative to mandrel 112 is limited.

Once safety joint 100 is in the configuration depicted in FIG. 4, the weight from the surface can be reduced in a controlled fashion to allow decompression of the tubular string. Continued movement of mandrel 112 in the uphole direction now causes shoulder 108 of receptacle 102 to come in contact with or engage upper ring 170 once receptacle 102 returns to a position within its initial longitudinal range relative to mandrel 112. This contact causes upper ring 170 to slide along profile 162 until support thereunder is lost. Upper ring 170 then snaps into contact with mandrel 112, as best seen in FIG. 5. In this configuration, neither upper ring 170 nor lower ring 172 limits longitudinal travel of receptacle 102 relative to mandrel 112. As such, mandrel 112 and the upper portion of the tubular string can be retrieved uphole or to the surface while leaving receptacle 102 and the lower portion of the tubular string in position in the wellbore.

Figure 6:
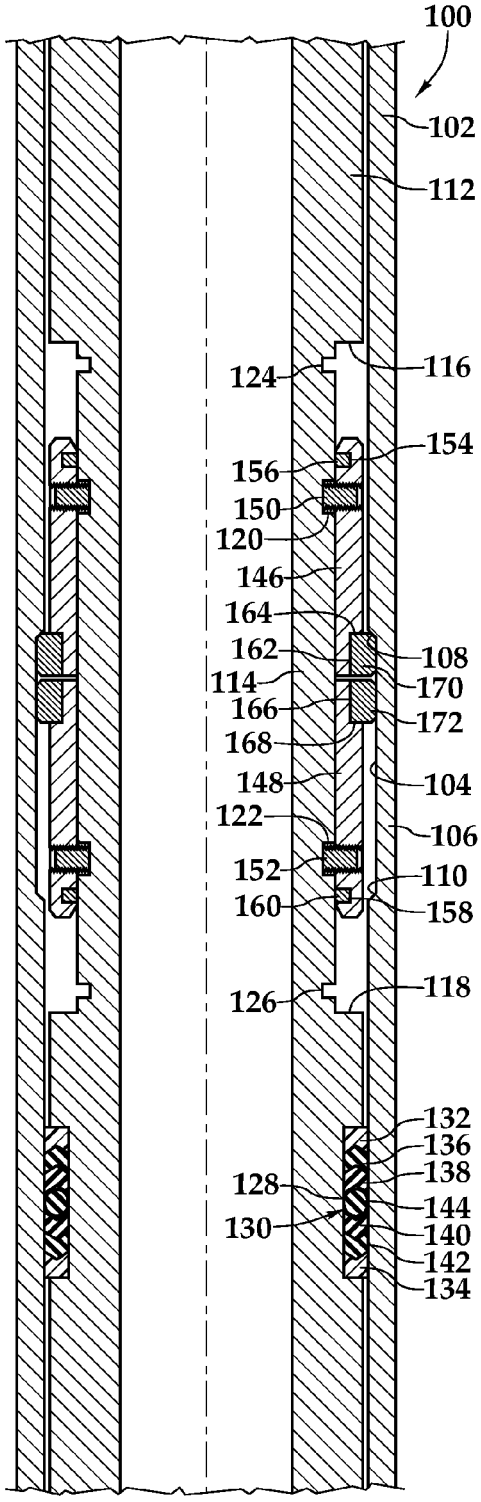
FIG. 6 is a cross sectional view of an apparatus for disconnecting an upper part of a tubular string from a lower part of a tubular string during downhole operations in a fifth configuration according to an embodiment of the present invention.
Figure 7:
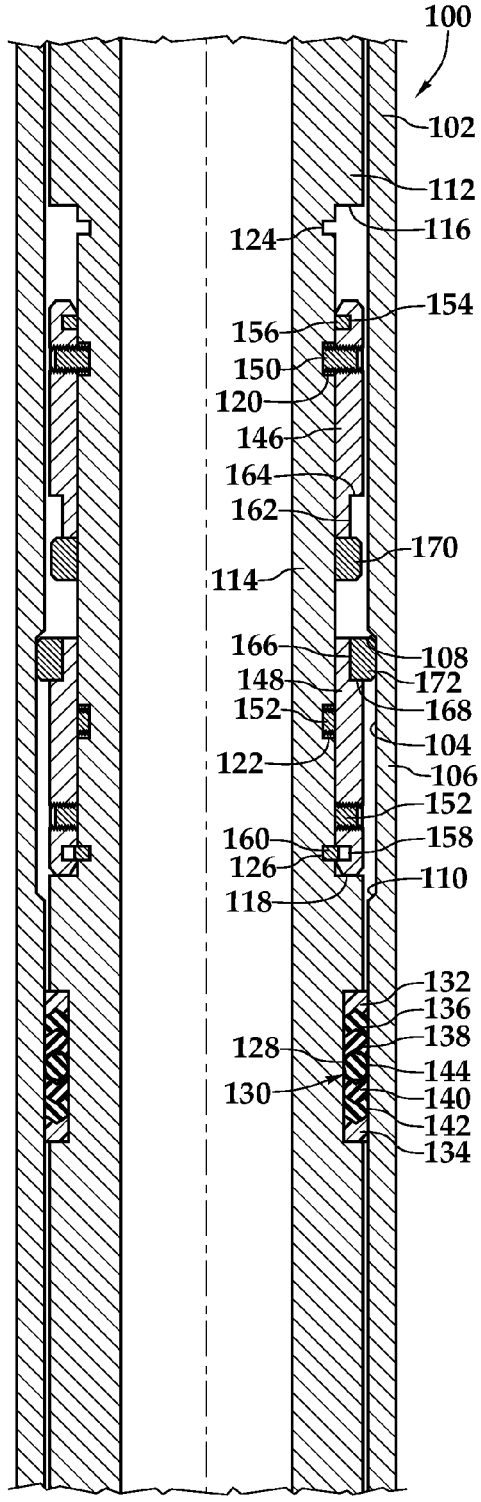
FIG. 7 is a cross sectional view of an apparatus for disconnecting an upper part of a tubular string from a lower part of a tubular string during downhole operations in a sixth configuration according to an embodiment of the present invention.
Figure 8:
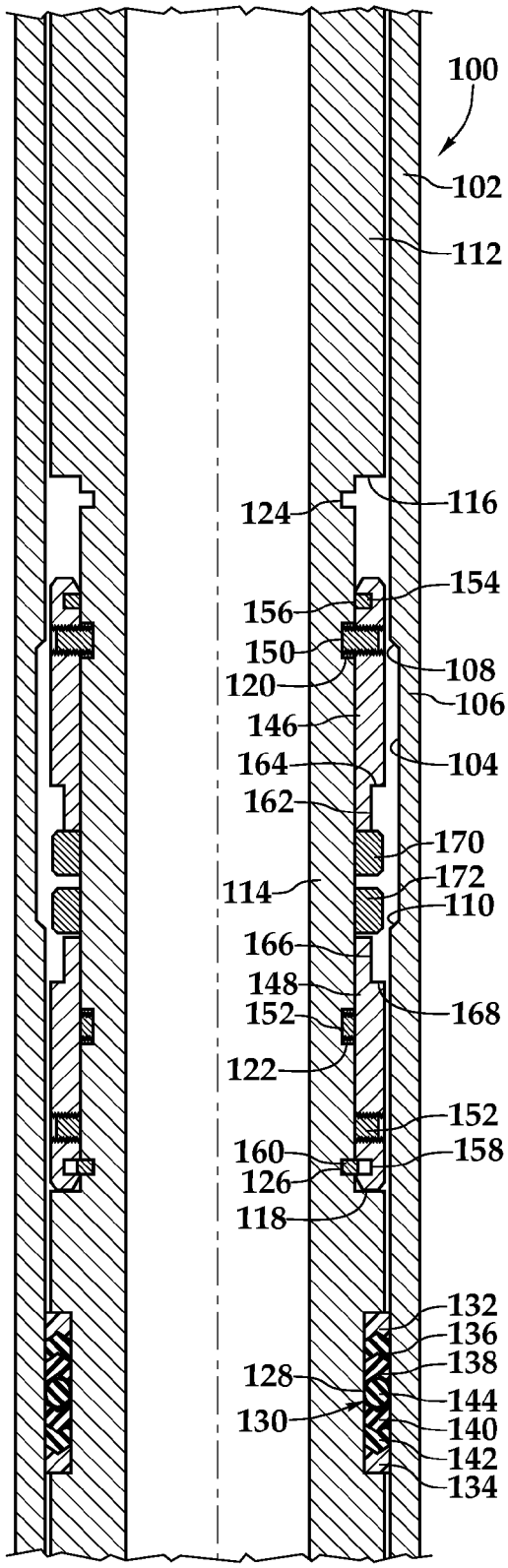
FIG. 8 is a cross sectional view of an apparatus for disconnecting an upper part of a tubular string from a lower part of a tubular string during downhole operations in a seventh configuration according to an embodiment of the present invention.

A second operating mode of safety joint 100 will now be described with reference to FIGS. 6-8. As illustrated in FIG. 6, the upper portion of tubular string is being raised from the surface which has caused mandrel 112 to move uphole relative to receptacle 102 such that upper ring 170 has come in contact with or been engaged by shoulder 108 of receptacle 102. In this configuration, application of a predetermined tensile longitudinal force between mandrel 112 and receptacle 102 causes shear pins 152 to part due to the force of upper ring 170 on lower ring 172. When shear pins 152 part, lower sleeve 148 is shifted in the downhole direction until lower sleeve 148 contacts shoulder 118, as best seen in FIG. 7. In this position, retainer ring 160 snaps into retainer ring receiving groove 126 which prevents subsequent longitudinal movement of lower sleeve 148.

During the initial movement of lower sleeve 148, upper ring 170 slides along profile 162 until support thereunder is lost. Upper ring 170 then snaps into contact with mandrel 112. In this configuration, upper ring 170 no longer limits longitudinal travel of receptacle 102 relative to mandrel 112. The longitudinal travel of receptacle 102 relative to mandrel 112 in the downhole direction outside of the initial range is allowed but the extent of the travel is now limited by lower ring 172 due to the engagement of shoulder 108 of receptacle 102 with lower ring 172. In this manner, any tensile elongation of receptacle 102 and the portion of the tubular string therebelow during the operation of safety joint 100 will not result in recoil of the tubular string as the distance receptacle 102 can travel relative to mandrel 112 is limited.

Once safety joint 100 is in the configuration depicted in FIG. 7, the tensile force from the surface can be reduced in a controlled fashion to allow the tubular string to return to its unstressed state. Continued movement of mandrel 112 in the downhole direction now causes shoulder 110 of receptacle 102 to come in contact with or engage lower ring 172 once receptacle 102 returns to a position within its initial longitudinal range relative to mandrel 112. This contact causes lower ring 172 to slide along profile 166 until support thereunder is lost. Lower ring 172 then snaps into contact with mandrel 112, as best seen in FIG. 8. In this configuration, neither upper ring 170 nor lower ring 172 limits longitudinal travel of receptacle 102 relative to mandrel 112. As such, mandrel 112 and the upper portion of the tubular string can be retrieved uphole or to the surface while leaving receptacle 102 and the lower portion of the tubular string in position in the wellbore.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. An apparatus for separating a downhole tubular string into two parts, the apparatus comprising:

a receptacle operably associated with a first part of the downhole tubular string, the receptacle having a profiled surface;

a mandrel operably associated with a second part of the downhole tubular string, the mandrel slidably positioned relative to the receptacle;

a first sleeve slidably positioned between the receptacle and the mandrel, the first sleeve operable to be securably coupled to the mandrel in first and second positions relative to the mandrel, the first sleeve having a profile;

a second sleeve positioned between the receptacle and the mandrel, the second sleeve having a profile;

a first ring slidably positioned between the profile of the first sleeve and the profiled surface of the receptacle; and a second ring slidably positioned between the profile of the second sleeve and the profiled surface of the receptacle, the first and second rings initially limiting longitudinal movement of the receptacle relative to the mandrel in first and second directions;

wherein, upon application of a predetermined longitudinal force between the mandrel and the receptacle, the receptacle engages the second ring such that the second ring engages the first ring which shifts the first sleeve from the first position to the second position and allows the second ring to slide off the profile of the second sleeve such that the receptacle engages the first ring, thereby limiting longitudinal movement of the receptacle in the first direction; and wherein, upon subsequent movement of the receptacle in the second direction relative to the mandrel, the receptacle engages the first ring such that the first ring slides off the profile of the first sleeve, thereby allowing longitudinal movement of the receptacle relative to the mandrel in both the first and second directions.

2. The apparatus as recited in claim 1 wherein the profiled surface of the receptacle further comprises a radially increased portion of an inner surface of the receptacle.

3. The apparatus as recited in claim 1 further comprising at least one seal positioned between the receptacle and the mandrel.

4. The apparatus as recited in claim 1 wherein the receptacle is positioned to an exterior of the mandrel.

5. The apparatus as recited in claim 1 wherein the mandrel includes a radially reduced portion and wherein the first and second sleeves are positioned within the radially reduced portion of the mandrel.

6. The apparatus as recited in claim 1 wherein the first sleeve is securably coupled to the mandrel in the first position with at least one shear pin.

7. The apparatus as recited in claim 1 wherein the first sleeve is securably coupled to the mandrel in the second position with a retaining ring.

8. The apparatus as recited in claim 1 wherein the first and second rings are split rings that are radially outwardly biased when positioned respectively on the profiles of the first and second sleeves.

9. An apparatus for separating a downhole tubular string into two parts, the apparatus comprising:

a receptacle operably associated with a first part of the downhole tubular string, the receptacle having a profiled surface;

a mandrel operably associated with a second part of the downhole tubular string, the mandrel slidably positioned relative to the receptacle;

first and second sleeves slidably positioned between the receptacle and the mandrel and operable to be securably coupled to the mandrel in respective first and second positions relative to the mandrel, the first and second sleeves each having a profile; and first and second rings slidably positioned respectively between the profiles of the first and second sleeves and the profiled surface of the receptacle, the first and second rings initially limiting longitudinal movement of the receptacle relative to the mandrel in first and second directions;

wherein, upon application of a predetermined longitudinal force between the mandrel and the receptacle, the receptacle engages the second ring such that the second ring engages the first ring which shifts the first sleeve from the first position to the second position and allows the second ring to slide off the profile of the second sleeve such that the receptacle engages the first ring, thereby limiting longitudinal movement of the receptacle in the first direction; and wherein, upon subsequent movement of the receptacle in the second direction relative to the mandrel, the receptacle engages the first ring such that the first ring slides off the profile of the first sleeve, thereby allowing longitudinal movement of the receptacle relative to the mandrel in both the first and second directions.

10. The apparatus as recited in claim 9 wherein the profiled surface of the receptacle further comprises a radially increased portion of an inner surface of the receptacle.

11. The apparatus as recited in claim 9 further comprising at least one seal positioned between the receptacle and the mandrel.

12. The apparatus as recited in claim 9 wherein the receptacle is positioned to an exterior of the mandrel.

13. The apparatus as recited in claim 9 wherein the mandrel includes a radially reduced portion and wherein the first and second sleeves are positioned within the radially reduced portion of the mandrel.

14. The apparatus as recited in claim 9 wherein the first sleeve is securably coupled to the mandrel in the first position with at least one shear pin.

15. The apparatus as recited in claim 9 wherein the first sleeve is securably coupled to the mandrel in the second position with a retaining ring.

16. The apparatus as recited in claim 9 wherein the first and second rings are split rings that are radially outwardly biased when positioned respectively on the profiles of the first and second sleeves.

17. A method for separating a downhole tubular string into two parts, the method comprising:

operably associating a receptacle with a first part of the tubular string, the receptacle having a profiled surface;

operably associating a mandrel with a second part of the tubular string, the mandrel slidably positioned relative to the receptacle;

initially limiting movement in first and second longitudinal directions of the receptacle relative to the mandrel with first and second rings slidably positioned respectively, between profiles of first and second sleeves and the profiled surface of the receptacle, the first and second sleeves slidably positioning between the receptacle and the mandrel;

engaging the second ring with the receptacle such that the second ring engages the first ring;

applying a predetermined longitudinal force between the mandrel and the receptacle;

shifting the receptacle in the first direction relative to the mandrel;

shifting the first sleeve from a first position to a second position and shifting the second ring off the profile of the second sleeve such that the receptacle engages the first ring;

limiting further movement of the receptacle relative to the mandrel in the first direction;

releasing the predetermined longitudinal force between the mandrel and the receptacle;

shifting the receptacle in the second direction relative to the mandrel;

engaging the first ring with the receptacle such that the first ring slides off the profile of the first sleeve; and enabling longitudinal movement of the receptacle in both the first and second directions.

18. The method as recited in claim 17 wherein applying a predetermined longitudinal force between the mandrel and the receptacle further comprises parting at least one shearable element.

19. The method as recited in claim 17 wherein applying a predetermined longitudinal force between the mandrel and the receptacle further comprises applying a tensile force.

20. The method as recited in claim 17 wherein applying a predetermined longitudinal force between the mandrel and the receptacle further comprises applying a compressive force.

* * * * *